United States Patent [19]

Barbe et al.

[11] 4,431,479

[45] Feb. 14, 1984

[54] PROCESS FOR IMPROVING AND RETAINING PULP PROPERTIES

[75] Inventors: Michel Barbe, Candiac; Rajinder S. Seth; Derek H. Page, both of Pointe Claire, all of Canada

[73] Assignee: Pulp and Paper Research Institute of Canada, Pointe Claire, Canada

[21] Appl. No.: 377,111

[22] Filed: May 11, 1982

[51] Int. Cl.[3] ..... D21D 1/00

[52] U.S. Cl. ..... 162/9; 162/56; 162/71; 162/78; 162/100

[58] Field of Search ..... 162/9, 56, 28, 78, 71, 162/100

[56] References Cited

U.S. PATENT DOCUMENTS 4,214,778 1/1981 Lindahl et al. ..... 162/78

4,259,148 3/1981 Beath et al. ..... 162/71

FOREIGN PATENT DOCUMENTS 2335014 11/1975 Fed. Rep. of Germany ..... 162/28

OTHER PUBLICATIONS

Chemical Engineering, vol. 83, No. 26, 12/6/76 pp. 89–91.

*Primary Examiner*—William F. Smith

*Attorney, Agent, or Firm*—Lawrence I. Field

[57] ABSTRACT

A method is provided for treating pulp fibres, that have already been curled which method comprises: subjecting the pulp to a heat treatment while the pulp is at a high consistency, thereby to render the curl permanent to subsequent mechanical action. This permanent curl has advantages for papermachine runnability and for increasing the toughness of the finished product.

19 Claims, No Drawings

PROCESS FOR IMPROVING AND RETAINING PULP PROPERTIES

BACKGROUND OF THE INVENTION (i) Field of the Invention

This invention relates to a process for treating lignocellulosic pulp fibres of either softwoods or hardwoods to provide pulps of improved properties. In particular this invention is directed to the treatment of mechanical pulps and high-yield chemical pulps to improve and retain the properties of such pulps.

(ii) Description of the Prior Art

Newsprint traditionally has been manufactured from a furnish consisting of a mixture of a mechanical pulp and a chemical pulp. Mechanical pulp is used because it imparts certain desired properties to the furnish: namely, its high light scattering coefficient contributes to paper opacity and allows the use of a thinner sheet; its high oil absorbency improves ink acceptance during printing.

Chemical pulps are used because they impart properties to the furnish which improve its runnability. Runnability refers to properties which allow the wet web to be transported at high speed through the forming, pressing and drying sections of a papermachine and allows the dried paper sheet to be reeled and printed in an acceptable manner. Runnability contributes to papermachine and pressroom efficiency.

It is believed that improved runnability in chemical pulp is due to high wet-web strength and drainage rate. Wet and dry stretch are important because they are believed to contribute to preventing concentrations of stress around paper defects, thereby minimizing breaks. High drainage rates lower the water content and are believed to yield a less fragile web.

Mechanical pulps including stone groundwood (SG) and pressurized stone groundwood (PSG) can be made to provide wet stretch but only at the expense of poor drainage. Higher quality mechanical pulps are obtained by manufacture in open discharge refiners, to produce refiner mechanical pulp (RMP) and in pressurized thermomechanical pulp (TMP). Still further upgraded mechanical pulps were provided by chemical pretreatment of the wood chips prior to refining to provide chemimechanical pulp (CMP or CTMP).

U.S. Pat. No. 3,446,699 issued May 27, 1965 to Asplund et al. provided a method for producing mechanical and chemimechanical or semichemical pulps from lignocellulose-containing material, in order to provide what was alleged to be improved quality of the fibres with improved defibration.

U.S. Pat. No. 3,558,428 issued Jan. 26, 1971 to Asplund et al. provided a method for manufacturing chemimechanical pulps involving heating and defibrating the same in an atmosphere of vapour at elevated temperatures and under corresponding pressure of the impregnated chips to provide a more rapid and effective impregnation.

U.S. Pat. No. 4,116,758 issued Sept. 26, 1978 to M. J. Ford provided a process for producing high-yield chemimechanical pulps from woody lignocellulose material by treatment with an aqueous solution of a mixture of sulfite and bisulfite, to provide a pulp which can be readily defibered by customary mechanical means to provide a pulp having excellent strength characteristics.

Today's papermaker is faced with the problems of decreasing forest resources, an increasing demand for paper products and stringent environmental laws. Low-yield chemical pulps, e.g. sulphite and kraft pulps, contribute highly to such problems.

The fibres of low-yield chemical pulps are known for their desirable dry- and wet-web strength properties. Observations of low-yield chemical fibres in a formed paper sheet indicate that these tend to have a kink and curl which is said to contribute, in an advantageous way, to the papermachine runnability and to certain physical properties. Mechanical pulps lack the desirable strength properties to replace, in whole or in part, low-yield chemical pulps, e.g. kraft or sulphite pulps, in linerboard, newsprint, tissue, printing grades and coated-base grade of paper. Consequently, it has been an aim of the art to improve the physical properties of mechanical and high-yield chemical pulps, so that such improved pulps would be used to replace low-yield chemical pulps:

A number of mechanical devices have been built to produce curled chemical and mechanical fibres in order to improve certain physical properties. Two such mechanical fibre-curling devices are disclosed in H. S. Hill, U.S. Pat. No. 2,516,384 and E. F. Erikson U.S. Pat. No. 3,054,532.

H. S. Hill et al. in Tappi, Vol. 33, No. 1, pp. 36–44, 1950, described a "Curlator" designed to produce curled fibres. The process consisted of rolling fibres into bundles at a consistency of around 15%–35%, followed by dispersion. Advantages claimed were higher wet-web stretch, improved drainage, and higher tear strength and stretch of the finished product. These advantages were at the expense of certain other properties, notably tensile strength.

W. B. West in Tappi, Vol. 47, No. 6, pp. 313–317, 1964, describes high consistency disc refining to produce the same action.

D. H. Page in Pulp Paper Mag. Canada, Vol. 67, No. 1, pp. T2–12, 1966, showed that the curl introduced was both at a gross level and at a fine level which he called "microcompressions". Both types of curl were advantageous.

J. H. De Grâce and D. H. Page in Tappi, Vol. 59, No. 7, pp. 98–101, 1976, showed that curl could be produced adventitiously during bleaching of pulps, by the mechanical action of pumps and stirrers at high consistency.

R. P. Kibblewhite and D. Brookes in Appita, Vol. 28, No. 4, pp. 227–231, 1975, claimed that this adventitious curl could have advantages for practical runnability of papermachines.

High-consistency mechanical defibration of wood chips is known to produce curled, kinked and twisted fibres. Kinked fibres are known to be particularly effective in developing extensibility in wet webs if the kinks are set in position so that they survive the action of pumps and agitators at low consistency and retain their kinked and curled state in the formed sheet. This ensures enhancement of the wet-web stretch and certain other physical properties.

A number of chemical treatment methods have been reported to enhance and retain fibre curl in a refined pulp. In one, Canadian Pat. No. 1,102,969 issued June 16, 1981 to A. J. Kerr et al., improvement in tearing strength of the pulp is alleged by the treatment of delignified lignocellulosic or cellulose pulp derived from a chemical, semichemical or chemimechanical pulping process at a pressure of at least one atmosphere, with sufficient gaseous ammonia to be taken up by moist pulp in an amount greater than 3% by weight to weight of oven dried pulp.

In another, Canadian Pat. No. 1,071,805 issued Feb. 19, 1980 to A. J. Barnet et al., a method of treatment of mechanical wood pulp is provided by cooking the pulp with aqueous sodium sulphite solution containing sufficient alkali to maintain a pH greater than about 3 during the cooking. The cooking was effected at an elevated temperature for a time sufficient to cause reaction with the pulp and to increase the drainage and wet stretch thereof, but for a time insufficient to cause substantial dissolution of liquor from the pulp, and insufficient to result in a pulp yield below about 90%. A minimum concentration of sodium sulphite was 1% since, below 1% sodium sulphite improvements were said to be too small to justify the expense of treatment.

DETAILED DESCRIPTION OF THE INVENTION

During the process of papermaking, most of the curl in both high-consistency refined mechanical and high-yield sulphite pulp is lost in the subsequent steps of handling at low consistency and high temperatures. This is also taught in the article by H. W. H. Jones in Pulp Paper Mag. Canada, Vol. 67, No. 6, pp. T283–291, 1966. Jones showed that when mechanical pulp fibres which are curled during high consistency refining are subjected to mild mechanical action in dilute suspension at a temperature of around 70° C. the curl tends to be removed. The increased tensile and burst strengths produced by removal of curl was seen as advantageous. Thus, curl in such pulps is normally removed in papermachine operation, since during practical papermaking, pulps are always subjected to mild mechanical action in dilute suspension at temperatures of the order of 70° C.

High-yield and ultra high-yield sulphite pulps are used as reinforcing pulps for manufacture of newsprint and other groundwood-containing papers. Although they may be subjected to high-consistency refining, their fibres are in practice substantially straight because the curl introduced in high-consistency refining is lost in subsequent handling.

Accordingly an object of one aspect of this invention is to provide a process for imparting and rendering permanent, the physical properties of such mechanical and high-yield chemical pulps in order to improve their papermachine runnability and pressroom efficiency.

An object of yet another aspect of this invention is to provide a non-chemical method of treating higher-yield pulps to improve and retain certain physical properties so that the pulp can be used to replace in whole or in part, the low-yield chemical pulps.

It is an object of another aspect of the present invention, to render permanent, by non-chemical means, the curl imparted to the fibres of high-consistency mechanically treated, mechanical and high-yield chemical pulps.

The mechanical pulps or high-yield chemical pulps included within the ambit of this invention can be produced by either mechanical defibration of wood, e.g. in stone groundwood (SG), pressurized stone groundwood (PSG), refiner mechanical pulp (RMP) and thermomechanical pulp (TMP) production or by mechanical defibration, at high consistency, followed or preceded by a chemical treatment of wood chips and pulps e.g. in the production of ultra-high-yield sulphite pulps (UHYS, yields in the range 100–85%), high-yield sulphite pulps (HYS) yields in the range 85–65%), chemi-thermomechanical (CTMP), high-yield chemimechanical (CMP), interstage thermomechanical and chemically post-treated mechanical pulp (MPC) or thermomechanical pulps (TMPC).

By a broad aspect of this invention, a method is provided for treating pulps, that have already been curled, which method comprises: subjecting the pulp to a heat treatment while the pulp is at a high consistency in the form of nodules or entangled mass, thereby to render the curl permanent to subsequent mechanical action.

By another aspect of this invention, a method is provided for treating high-yield or mechanical pulps, that have already been curled by a mechanical action at high consistency, which method comprises: subjecting the pulp to a heat treatment at a temperature of at least 100° C., while the pulp is at a high consistency of at least 15% thereby to render the curl permanent to subsequent mechanical action.

By yet another aspect of this invention, a method is provided for treating high-yield or mechanical pulps, that have already been curled by a high-consistency action, which method comprises: subjecting the pulp to a heat treatment at a temperature of 100° C.–170° C. for a time varying between 60 minutes and 2 minutes, while the pulp is at a high consistency of 15% to 35%, thereby to render the curl permanent to subsequent mechanical action.

The present invention in its broad aspects is a method which follows the mechanical action that has already made the fibres curly in either mechanical, ultra high-yield or high-yield pulps. Such a mechanical action generally takes place at high consistency (15%–35%), and may typically be a high-consistency disc refining action, e.g. as is generally used in pulp manufacture.

The method of aspects of this invention thus consists of a simple heat treatment of the pulp in the presence of water while it is retained in the form of nodules or entangled mass at high consistency. The process may involve temperatures above 100° C. in which case a pressure vessel is required.

While the invention is not to be limited to any theory, it is believed that the method sets the curl in place either by relief of stresses in the fibre or by a cross-linking mechanism, so that upon subsequent processing during papermaking, the fibres retain their curled form.

This curled form has particular advantages for the properties of the wet web, so that the runnability of the papermachine is improved. In addition, the toughness of the finished product is increased.

In general terms, the method begins with a pulp that has been converted to the curly state by mechanical action at high consistency, and in which the fibres are held in a curly state in the form of nodules or entangled mass. The pulp may be either purely mechanical e.g. stone groundwood, pressurized stone groundwood, refiner mechanical, thermomechanical, or a chemimechanical pulp such as ultra high-yield sulphite pulp or high-yield sulphite pulp. Conversion to a curly state is generally achieved naturally in the high-consistency refining action that is normally used for refiner mechanical, thermomechanical and ultra high-yield sulphite pulp. For stone groundwood, pressurized stone groundwood and high-yield sulphite pulp, it would be necessary to add to the normal processing a step that curls the fibres. This may be for example by use of the "Curlator" or high-consistency disc refining, or by use of the "Frotapulper" (E. F. Erikson, U.S. Pat. No. 3,054,532).

The pulp fibres may be lignocellulosic fibres produced by mechanical defibration, or by refining, or by refining in a disc refiner at high consistency, or by mechanical defibration at high consistency of wood chips, or by mechanical defibration at high consistency of wood chips followed or preceded by a chemical treatment, or by a single stage refining, or after two successive refinings, or between two successive refinings. They may alternatively be pulp fibres commercially produced under the designation of refiner mechanical pulp, pressurized refiner mechanical pulp and thermomechanical pulp either from a single stage or two-stage refining, or commercially produced under the designation of ultra high-yield pulps, high-yield pulps, high-yield chemimechanical pulps, interstage thermomechanical pulps and chemically post-treated mechanical or thermomechanical pulps, or may be part of the furnish, e.g. the refined rejects in mechanical pulp production or may be whole pulps.

The method consists of taking the curled pulp at high consistency (say 15–35%) in the form of nodules or entangled mass and subjecting it to heat treatment without appreciable drying of the pulp. The temperature and duration of the heat treatment controls the extent to which the curl in the fibres is rendered permanent, and this may be adjusted to match the advantages sought.

This method may be carried out as a batch method in a digester or as a continuous method through a steaming tube maintained at high pressure.

The method may also include the step of incorporating a brightening agent during heat treatment, to upgrade the brightness while retaining the improved pulp properties; or the subsequent steps of brightening or bleaching sequences to upgrade the brightness of the pulps while maintaining the improved pulp properties; or indeed may be carried out in brightened pulps thereby also to maintain adequate brightness after heat treatment.

Nowhere in the prior art is there disclosed a process in which a separate and sole heat treatment at high consistency and high temperatures is given to curled fibres in order to achieve the desired changes in the properties of the wood pulp being treated.

Among the advantages of the method of aspects of this invention in setting in fibre curl in high-yield pulps and mechanical pulps is to provide a means of controlling pulp properties in order to impart high wet-web stretch, work-to-rupture and increased drainage rates. In the case of high-yield pulps, in addition to the above wet-web properties, higher dry-sheet tear strength and stretch are also obtained.

Thus, by this invention, it has been discovered that when lignocellulosic pulp fibres, that have already been made curly, are heat treated at (a) consistencies from 10% to 35%, (b) temperatures from 100° C. to 170° C. using steam at corresponding pressures of 5 psig to 105 psig, (c) for a period of time of from 2 minutes to 60 minutes, fibre curl permanently sets in place, and the curl is made resistant to removal in subsequent mechanical action experienced by fibres in the papermaking process. The method of aspects of this invention improves drainage, wet-web stretch, wet-web work-to-rupture and dry-sheet tear strength and stretch.

In one variant, the method is to take a pulp that has been made curly by high-consistency (20–35%) refining, and to set in the curl (and perhaps microcompressions) by subjecting it at a high consistency to an elevated temperature (e.g. 110° C.–160° C.) for a brief time (e.g. 1 minute to 1 hour). This set-in curl is resistant to removal by the hot disintegration experienced during papermaking. The advantages of such a pulp are: 1. higher wet-web stretch; 2. higher tearing strength; and 3. better drainage.

The method may be a batch process, i.e. if the pulp is placed in a pressure vessel e.g. a closed reaction vessel or digester, or it may be a continuous process e.g. through a steaming tube maintaining high pressures.

The temperature and duration of the heat treatment controls the extent to which the curl in the fibres is rendered permanent, and this may be adjusted to match the advantages sought. Preferred conditions are as follows: temperatures of from above 100° to 170° with corresponding steam pressures of 5 psig to 105 psig and for periods from 2 minutes to 60 minutes.

The treatment according to aspects of this invention has been observed to render fibre curl permanent including fibre twists, kinks and microcompressions.

Either during or after completion of the heat treatment the pulp may then be brightened in accordance with any of the well-known conventional brightening sequences.

In general, pulp fibres obtained after refining at high consistency are very curly. For mechanical pulps, if a mild disintegration treatment at room temperature is made on these pulps, the fibres retain substantially their curliness so as to produce wet webs with high wet-web stretch, work-to-rupture and fast drainage. However, in the papermaking process, pulps receive mechanical action at high temperatures and low consistencies so that their curliness is lost. It is believed that pulps which are given standard hot disintegration treatment in the laboratory at low consistency experience similar conditions during which the curliness is lost and the wet-web properties deteriorate.

The following examples are given to illustrate more clearly various embodiments of the invention. In the following examples, the tests were conducted in the following standard way:

Wet-web results were obtained following the procedure described by R. S. Seth, M. C. Barbe, J. C. R. Williams and D. H. Page in Tappi, Vol. 65, No. 3, pp. 135–138, 1982.

Wet-web percent solids, tensile strength, stretch and work-to-rupture were obtained on webs prepared by applying 0.7 kPa and 103 kPa wet-pressing pressures.

The percent stretch-to-break was obtained for wet-webs pressed so as to give a breaking length of 100 meters. It is considered that this value is a measure of the "toughness" of the wet-web and is an indication of the runnability of the pulp on a papermachine.

Changes in drainage rates are given by the measure of Canadian Standard Freeness.

Hot disintegration was done according to the procedure of C. W. Skeet and R. S. Allan in Pulp Paper Mag. Canada, Vol. 69, No. 8, pp. T222–224, Apr. 19, 1968.

The extent of fibre curliness has been quantified by an Image Analysis method as described by B. D. Jordan and D. H. Page in the Proceedings of the TAPPI International Paper Physics Conference, Harrison Hot Springs, B.C. (1979). High values of curl indices reflect curlier fibres.

In the examples following, two parameters have been used to follow the progress of the heat treatment effect.

First the curliness of the fibres has been measured, after a standard hot disintegration treatment at low consistency, that simulates the subsequent treatment that the pulp will receive in the papermaking process.

Secondly, the advantage of this new pulp (after hot disintegration) has been determined in terms of the extensibility (percent stretch-to-break) of wet webs prepared from the pulp pressed so as to give a breaking length of 100 meters. It is considered that this value is a measure of the "toughness" of the wet sheet, and is an indication of the runnability of the pulp on a papermachine.

EXAMPLE 1

This example is intended to illustrate that when pulp fibres are given a heat treatment, as described for aspects of this invention, they remain curly even after standard hot disintegration.

In this example pulp fibres were treated in a digester at 150° C. and at about 22% consistency for approximately 60 minutes.

The results obtained after the above treatment on a variety of mechanical, chemimechanical and chemical wood pulp fibres are reproduced below in Table I.

From the results, it is seen that the heat treatment produces the desired effects, on wet-web stretch and drainage, for all the lignocellulosic pulp fibres, e.g., mechanical pulp and high-yield sulphite pulp fibres. The treatment has no effect on cellulosic pulp fibres which contain little or no lignin.

EXAMPLE 2

This example illustrates the effect of the temperature of the treatment.

Lignocellulosic pulp fibres were treated in a digester at temperatures of 110°, 130°, 150° and 170° C. for 60 minutes and at approximately 2% consistency. The results reproduced in Table II were obtained after a standard hot disintegration.

TABLE I

THE EFFECT OF THE HEAT TREATMENT (150° C., 22% CONSISTENCY, 60 MINUTES) ON A VARIETY OF MECHANICAL, CHEMI-MECHANICAL AND CHEMICAL WOOD PULP FIBRES

| | | SG[1] | | PSG | | RMP[2] | | TMP[3] | |
|---|---|---|---|---|---|---|---|---|---|
| | | Untreated | Heat Treated | Untreated | Heat Treated | Untreated | Heat Treated | Untreated | Heat Treated |
| Pulp and Fibre Properties | | | | | | | | | |
| Curl Index | | 0.180 | 0.204 | 0.163 | 0.203 | 0.143 | 0.258 | 0.121 | 0.239 |
| CSF (ml) | | 61 | 60 | 48 | 47 | 159 | 248 | 181 | 287 |
| Wet-Web Properties | | | | | | | | | |
| 0.7 kPa | Solids (%) | 17.8 | 14.5 | 15.7 | 14.7 | 18.3 | 19.2 | 18.9 | 18.4 |
| | Tensile (m) | 47.7 | 48.8 | 63.7 | 65.3 | 60.6 | 48.0 | 91.5 | 60.5 |
| | Stretch (%) | 7.05 | 11.7 | 8.91 | 12.8 | 5.05 | 11.3 | 6.32 | 18.6 |
| | Work to Rupture (mJ/g) | 39.7 | 62.7 | 70.4 | 105 | 38.3 | 58.3 | 69.0 | 124 |
| 103 kPa | Solids (%) | 20.2 | 20.4 | 24.4 | 20.5 | 24.8 | 24.2 | 25.6 | 22.5 |
| | Tensile (m) | 96.1 | 101 | 133 | 124 | 117 | 80.5 | 161 | 105 |
| | Stretch (%) | 7.13 | 9.45 | 8.26 | 11.3 | 4.85 | 9.19 | 4.82 | 14.9 |
| | Work to Rupture (mJ/g) | 77.4 | 110 | 131 | 177 | 73.5 | 84.3 | 90.8 | 201 |
| Wet-Web Stretch at 100 m Breaking Length (%) | | 6.29 | 8.49 | 8.16 | 11.4 | 4.50 | 7.64 | 5.90 | 16.9 |

| | | TMPC[4] (94% yield) | | SULPHITE PULPS (90% yield)[5] | | SULPHITE PULPS (78% yield)[6] | |
|---|---|---|---|---|---|---|---|
| | | Untreated | Heat Treated | Untreated | Heat Treated | Untreated | Heat Treated |
| Pulp and Fibre Properties | | | | | | | |
| Curl Index | | 0.182 | 0.229 | 0.102 | 0.220 | 0.169 | 0.220 |
| CSF (ml) | | 208 | 221 | 256 | 340 | 236 | 326 |
| Wet-Web Properties | | | | | | | |
| 0.7 kPa | Solids (%) | 20.8 | 17.1 | 22.7 | 17.3 | 20.6 | 19.2 |
| | Tensile (m) | 122 | 74.1 | 72.6 | 59.3 | 144 | 111 |
| | Stretch (%) | 8.83 | 20.8 | 4.15 | 13.2 | 6.38 | 16.2 |
| | Work to Rupture (mJ/g) | 129 | 203 | 35.7 | 90.5 | 116 | 244 |
| 103 kPa | Solids (%) | 27.2 | 22.8 | 29.7 | 23.4 | 28.3 | 24.6 |
| | Tensile (m) | 207 | 125 | 134 | 114 | 283 | 183 |
| | Stretch (%) | 5.68 | 16.3 | 3.24 | 7.08 | 5.04 | 12.3 |
| | Work to Rupture (mJ/g) | 136 | 272 | 48.9 | 95.3 | 162 | 286 |
| Wet-Web Stretch at 100 m Breaking Length (%) | | 7.38 | 18.2 | 3.53 | 8.54 | 8.0 | 17.7 |

| | | SULPHITE PULPS (70% yield)[7] | | SULPHITE PULPS (50% yield)[8] | | KRAFT PULP (50% yield)[8] | |
|---|---|---|---|---|---|---|---|
| | | Untreated | Heat Treated | Untreated | Heat Treated | Untreated | Heat Treated |
| Pulp and Fibre Properties | | | | | | | |
| Curl Index | | 0.148 | 0.216 | 0.236 | 0.285 | 0.208 | 0.254 |
| CSF (ml) | | 673 | 624 | 654 | 691 | 675 | 709 |
| Wet-Web Properties | | | | | | | |
| 0.7 kPa | Solids (%) | 26.1 | 21.5 | 27.4 | 27.2 | 27.5 | 34.3 |
| | Tensile (m) | 82.8 | 84.1 | 97.8 | 64.6 | 96.9 | 61.5 |
| | Stretch (%) | 2.38 | 9.79 | 21.5 | 25.5 | 15.8 | 17.8 |
| | Work to Rupture (mJ/g) | 20.3 | 110 | 234 | 170 | 174 | 125 |
| 103 kPa | Solids (%) | 29.1 | 29.2 | 30.0 | 32.0 | 32.0 | 38.7 |
| | Tensile (m) | 143 | 145 | 120 | 82.3 | 122 | 77.7 |
| | Stretch (%) | 1.95 | 5.88 | 17.5 | 22.3 | 9.87 | 11.6 |
| | Work to Rupture (mJ/g) | 27.3 | 94.6 | 241 | 196 | 129 | 96.1 |

TABLE I-continued

THE EFFECT OF THE HEAT TREATMENT (150° C., 22% CONSISTENCY, 60 MINUTES) ON A VARIETY OF MECHANICAL, CHEMI-MECHANICAL AND CHEMICAL WOOD PULP FIBRES

| | | | | | | |
|---|---|---|---|---|---|---|
| Wet-Web Stretch at 100 m Breaking Length (%) | 2.23 | 8.05 | 20.1 | 19.0 | 13.5 | 9.59 |

[1]Commercial samples
[2]Refined at 6.75 MJ/kg and 17% consistency
[3]Refined at 8.09 MJ/kg and 30% consistency after second stage
[4]Pulp (3); cooked to 94% yield by sodium-base sulphite liquor at 10% consistency
[5]Refined at 7.60 MJ/kg and 17% consistency
[6]Refined at 2.20 MJ/kg and 17% consistency
[7]Refined at 0.57 MJ/kg and 9% consistency
[8]Curlated in a mixer for 2.5 hours at 20% consistency

TABLE II

THE EFFECT OF THE TEMPERATURE OF THE TREATMENT

| | | Refiner Mechanical[1] Pulp | | | | | Thermomechanical[2] Pulp | | | | |
|---|---|---|---|---|---|---|---|---|---|---|---|
| Treatment Temperature (°C.) | | Untreated | 110 | 130 | 150 | 170 | Untreated | 110 | 130 | 150 | 170 |
| Pulp and Fibre Properties | | | | | | | | | | | |
| Curl Index | | 0.143 | 0.178 | 0.225 | 0.258 | 0.259 | 0.121 | 0.138 | 0.180 | 0.239 | 0.261 |
| CSF (ml) | | 159 | 207 | 259 | 248 | 231 | 181 | 244 | 292 | 287 | 284 |
| Wet-Web Properties | | | | | | | | | | | |
| 0.7 kPa | Solids (%) | 18.3 | 18.2 | 23.2 | 19.2 | 18.0 | 18.9 | 18.6 | 18.6 | 18.4 | 19.4 |
| | Tensile (m) | 60.6 | 62.4 | 65.5 | 48.0 | 50.7 | 91.5 | 85.5 | 75.4 | 60.5 | 56.4 |
| | Stretch (%) | 5.05 | 7.73 | 7.28 | 11.3 | 12.5 | 6.32 | 8.61 | 13.0 | 18.6 | 19.6 |
| | Work to Rupture (mJ/g) | 38.3 | 45.8 | 58.5 | 58.3 | 77.7 | 69.0 | 88.9 | 114 | 124 | 143 |
| 103 kPa | Solids (%) | 24.8 | 23.2 | 25.0 | 24.2 | 22.1 | 25.6 | 23.4 | 22.7 | 22.5 | 23.6 |
| | Tensile (m) | 117 | 104 | 93.4 | 80.5 | 80.7 | 161 | 147 | 117 | 105 | 88.5 |
| | Stretch (%) | 4.85 | 5.62 | 6.75 | 9.19 | 10.4 | 4.82 | 6.87 | 11.1 | 14.9 | 18.8 |
| | Work to Rupture (mJ/g) | 73.5 | 69.8 | 75.7 | 84.3 | 100 | 90.8 | 119 | 187 | 201 | 216 |
| Wet-Web Stretch at 100 m Breaking Length (%) | | 4.50 | 5.86 | 6.50 | 7.64 | 9.52 | 5.90 | 8.13 | 12.7 | 16.9 | 18.0 |

| | | High-Yield Sulphite Pulp (90% yield)[3] | | | | | High-Yield Sulphite Pulp (70% yield)[4] | | | | |
|---|---|---|---|---|---|---|---|---|---|---|---|
| Treatment Temperature (°C.) | | Untreated | 110 | 130 | 150 | 170 | Untreated | 110 | 130 | 150 | 170 |
| Pulp and Fibre Properties | | | | | | | | | | | |
| Curl Index | | 0.153 | 0.166 | 0.206 | 0 226 | 0.221 | 0.147 | 0.181 | 0.217 | 0.237 | 0.239 |
| CSF (ml) | | 279 | 292 | 358 | 287 | 269 | 685 | 692 | 675 | 601 | 648 |
| Wet-Web Properties | | | | | | | | | | | |
| 0.7 kPa | Solids (%) | 20.5 | 22.5 | 20.8 | 19.2 | 17.3 | 27.4 | 27.3 | 26.3 | 24.3 | 25.9 |
| | Tensile (m) | 73.3 | 74.5 | 60.2 | 63.0 | 72.1 | 74.0 | 75.8 | 76.5 | 91.6 | 68.5 |
| | Stretch (%) | 5.45 | 6.51 | 11.1 | 15.8 | 14.9 | 2.10 | 4.07 | 8.81 | 17.8 | 5.04 |
| | Work to Rupture (mJ/g) | 49.0 | 71.9 | 97.9 | 107 | 137 | 16.2 | 32.1 | 93.7 | 189 | 38.4 |
| 103 kPa | Solids (%) | 24.9 | 26.5 | 23.9 | 23.4 | 21.8 | 31.1 | 31.1 | 30.3 | 28.6 | 30.7 |
| | Tensile (m) | 118 | 107 | 97.6 | 101 | 120 | 124 | 121 | 108 | 124 | 117 |
| | Stretch (%) | 4.02 | 5.42 | 7.82 | 11.1 | 11.2 | 2.00 | 3.37 | 5.06 | 12.2 | 3.75 |
| | Work to Rupture (mJ/g) | 56.7 | 76.0 | 110 | 143 | 157 | 26.3 | 39.4 | 73.9 | 203 | 49.7 |
| Wet-Web Stretch at 100 m Breaking Length (%) | | 4.61 | 5.54 | 7.96 | 10.9 | 12.5 | 2.21 | 3.72 | 6.23 | 15.3 | 4.04 |

[1]Refined at 6.75 MJ/kg and 17% consistency
[2]Refined at 8.09 MJ/kg and pulp at 30% consistency after second stage refining
[3]Refined at 7.60 MJ/kg and 17% consistency
[4]Refined at 0.64 MJ/kg and 30% consistency

EXAMPLE 3

This example illustrates the effect of the time for the treatment.

Lignocellulosic pulp fibres at approximately 22% consistency were treated in a digester at 150° C. for 2, 10 and 60 minutes respectively. The results reproduced in Table III were obtained after a standard hot disintegration.

It can be seen that the time, as well as the temperature (Example 2), control the extent to which the curl in the fibres is rendered permanent. Both variables can be adjusted to yield pulp with the required properties sought.

In addition to the time to maintain the desired properties of curly fibres and temperature of the treatment described above, the extent to which fibre curl is present, after heat treatment and hot disintegration also depends on the state of the fibres immediately after refining. In Table III it can be seen that for two 70%-yield sulphite pulps, the one refined at 30% consistency, i.e., containing more curly fibres, will require a shorter heat treatment and/or a treatment at a lower temperature to achieve the same wet-web strength properties as that for the pulp refined at 9% consistency.

EXAMPLE 4

This example illustrates the effect of the consistency of the pulp fibres when submitted to heat treatment.

TABLE III

THE EFFECT OF THE TIME FOR THE TREATMENT

| | High Yield Sulphite Pulp[3] |
|---|---|

TABLE III-continued

THE EFFECT OF THE TIME FOR THE TREATMENT

| | Refiner Mechanical Pulp[1] | | | | Thermomechanical Pulp[2] | | | | (90% yield) | |
|---|---|---|---|---|---|---|---|---|---|---|
| Time for Treatment (minutes) | Un-treated | 2 | 10 | 60 | Un-treated | 2 | 10 | 60 | Un-treated | 2 |
| Pulp and Fibre Properties | | | | | | | | | | |
| Curl Index | 0.143 | 0.189 | 0.210 | 0.258 | 0.121 | 0.152 | 0.168 | 0.239 | 0.102 | 0.178 |
| CSF (ml) | 159 | 214 | 206 | 248 | 181 | 200 | 225 | 287 | 256 | 294 |
| Wet-Web Properties | | | | | | | | | | |
| 0.7 kPa Solids (%) | 18.3 | 20.5 | 17.9 | 19.2 | 18.9 | 20.8 | 20.5 | 18.4 | 22.7 | 20.4 |
| 0.7 kPa Tensile (m) | 60.6 | 57.4 | 58.8 | 48.0 | 91.5 | 78.4 | 80.1 | 60.5 | 72.6 | 57.1 |
| 0.7 kPa Stretch (%) | 5.05 | 7.73 | 9.83 | 11.3 | 6.32 | 8.82 | 11.2 | 18.6 | 4.15 | 7.48 |
| 0.7 kPa Work to Rupture (mJ/g) | 38.3 | 54.5 | 63.5 | 58.3 | 69.0 | 89.5 | 112 | 124 | 35.7 | 56.5 |
| 103 kPa Solids (%) | 24.8 | 27.5 | 23.0 | 24.2 | 25.6 | 26.1 | 27.0 | 22.5 | 29.7 | 25.0 |
| 103 kPa Tensile (m) | 117 | 107 | 97.2 | 80.5 | 161 | 125 | 135 | 105 | 134 | 100 |
| 103 kPa Stretch (%) | 4.85 | 5.17 | 7.51 | 9.19 | 4.82 | 6.57 | 7.79 | 14.9 | 3.24 | 5.04 |
| 103 kPa Work to Rupture (mJ/g) | 73.5 | 66.1 | 83.1 | 84.3 | 90.8 | 115 | 135 | 201 | 48.9 | 69.1 |
| Wet-Web Stretch at 100 m Breaking Length (%) | 4.50 | 5.32 | 7.66 | 7.64 | 5.90 | 7.62 | 9.53 | 16.9 | 3.53 | 5.17 |

| | High-Yield Sulphite Pulp[3] (90% Yield) | | High-Yield Sulphite Pulp[4] (70% yield) | | | | High-Yield Sulphite Pulp[5] (70% Yield) | | | |
|---|---|---|---|---|---|---|---|---|---|---|
| Time for Treatment (minutes) | 10 | 60 | Un-treated | 2 | 10 | 60 | Un-treated | 2 | 10 | 60 |
| Pulp and Fibre Properties | | | | | | | | | | |
| Curl Index | 0.179 | 0.220 | 0.148 | 0.155 | 0.218 | 0.216 | 0.147 | 0.187 | 0.214 | 0.237 |
| CSF (ml) | 363 | 340 | 673 | 674 | 694 | 624 | 685 | 698 | 678 | 601 |
| Wet-Web Properties | | | | | | | | | | |
| 0.7 kPa Solids (%) | 18.5 | 17.3 | 26.1 | 28.1 | 25.0 | 21.5 | 27.4 | 24.6 | 24.5 | 24.3 |
| 0.7 kPa Tensile (m) | 47.1 | 59.3 | 82.8 | 86.2 | 71.5 | 84.1 | 74.0 | 51.5 | 91.4 | 91.6 |
| 0.7 kPa Stretch (%) | 9.57 | 13.2 | 2.38 | 2.57 | 4.84 | 9.79 | 2.10 | 6.11 | 18.3 | 17.8 |
| 0.7 kPa Work to Rupture (mJ/g) | 57.8 | 90.5 | 20.3 | 23.5 | 40.3 | 110 | 16.2 | 35.2 | 201 | 189 |
| 103 kPa Solids (%) | 24.5 | 23.4 | 29.1 | 31.0 | 31.5 | 29.2 | 31.1 | 30.0 | 31.0 | 28.6 |
| 103 kPa Tensile (m) | 95.4 | 114. | 143 | 124 | 130 | 145 | 124 | 94.4 | 150 | 124 |
| 103 kPa Stretch (%) | 6.17 | 7.08 | 1.95 | 2.23 | 3.40 | 5.88 | 2.00 | 4.15 | 9.97 | 12.2 |
| 103 kPa Work to Rupture (mJ/g) | 72.6 | 95.2 | 27.3 | 28.4 | 49.5 | 94.6 | 26.3 | 45.2 | 158 | 203 |
| Wet-Web Stretch at 100 m Breaking Length (%) | 6.01 | 8.54 | 2.23 | 2.36 | 3.76 | 8.05 | 2.21 | 4.31 | 16.5 | 15.3 |

[1]Refined at 6.75 MJ/kg and 17% consistency
[2]Refined at 8.09 MJ/kg and 30% consistency
[3]Refined at 7.60 MJ/kg and 17% consistency
[4]Refined at 0.57 MJ/kg and 9% consistency
[5]Refined at 0.64 MJ/kg and 30% consistency Lignocellulosic pulp fibres were treated in a digester at 150° C. for 60 minutes at consistencies of 5, 10, 20, and 25%. For the purposes of this specification, the term "% consistency" means the percentage of oven-dried weight of pulp fibres to the total weight of pulp fibres plus water. The results reproduced in Table IV were obtained after a standard hot disintegration.

The effect of the treatment is greater, the higher the consistency of the pulp fibres. The treatment has no effect on pulp fibres at low consistency, typically lower than 5%.

EXAMPLE 5

This example illustrates the effect of the heat treatment on the wet-web and dry-handsheet properties of high-yield pulps.

The lignocellulosic pulp fibres were heat treated in a digester at 150° C. and at about 20% consistency for approximately 60 minutes. For the pulp fibres, in the high-yield range, the heat treatment improves, in addition to the wet-web stretch and work to rupture, the dry handsheet tear strength and stretch (Table V).

EXAMPLE 6

This example illustrates the effect of the pH of the pulp fibres during the heat treatment. A 70% yield sulphite pulp at a pH of 3.2 was heat treated in a digester at 150° C. and at about 20% consistency for approximately 60 minutes.

TABLE IV

THE EFFECT OF THE CONSISTENCY OF THE PULP FIBRES DURING HEAT TREATMENT

| Consistency of pulp fibres during heat treatment (%) | Thermomechanical Pulp[1] | | | | | High-Yield Sulphite Pulp (90% Yield)[2] | | | | |
|---|---|---|---|---|---|---|---|---|---|---|
| | Untreated | 5 | 10 | 20 | 25 | Untreated | 5 | 10 | 20 | 25 |
| Pulp and Fibre Properties | | | | | | | | | | |
| Curl Index | 0.121 | 0.169 | 0.154 | 0.233 | 0.243 | 0.128 | 0.163 | 0.181 | 0.201 | 0.216 |
| CSF (ml) | 181 | 255 | 217 | 281 | 302 | 338 | 414 | 390 | 403 | 429 |
| Wet-Web Properties | | | | | | | | | | |
| 0.7 kPa Solids (%) | 18.9 | 24.9 | 19.4 | 21.9 | 22.0 | 22.5 | 21.3 | 21.7 | 19.8 | 19.3 |
| 0.7 kPa Tensile (m) | 91.5 | 93.6 | 90.6 | 59.1 | 62.3 | 69.5 | 69.3 | 62.3 | 63.0 | 64.5 |
| 0.7 kPa Stretch (%) | 6.32 | 10.8 | 9.28 | 16.5 | 17.6 | 4.98 | 5.94 | 8.09 | 12.8 | 14.3 |
| 0.7 kPa Work to rupture (mJ/g) | 69.0 | 137 | 108 | 119 | 129 | 39.0 | 47.2 | 65.0 | 95.3 | 118 |
| Solids (%) | 25.6 | 26.4 | 25.7 | 26.3 | 25.3 | 26.4 | 27.5 | 24.5 | 22.7 | 23.2 |

TABLE IV-continued

THE EFFECT OF THE CONSISTENCY OF THE PULP FIBRES DURING HEAT TREATMENT

| Consistency of pulp fibres during heat treatment (%) | | Thermomechanical Pulp[1] | | | | | High-Yield Sulphite Pulp (90% Yield)[2] | | | | |
|---|---|---|---|---|---|---|---|---|---|---|---|
| | | Untreated | 5 | 10 | 20 | 25 | Untreated | 5 | 10 | 20 | 25 |
| 103 kPa | Tensile (m) | 161 | 134 | 153 | 98.8 | 101 | 128 | 128 | 103 | 100 | 102 |
| | Stretch (%) | 4.82 | 9.52 | 7.84 | 14.0 | 16.8 | 3.38 | 4.22 | 5.47 | 11.3 | 12.2 |
| | Work to rupture (mJ/g) | 90.8 | 163 | 148 | 174 | 208 | 49.2 | 69.7 | 71.8 | 155 | 169 |
| Wet-web stretch at 100 m breaking length (%) | | 5.90 | 10.36 | 9.12 | 13.7 | 16.9 | 3.96 | 5.16 | 6.21 | 10.3 | 11.1 |

[1]Refined at 8.09 MJ/kg and 30% consistency
[2]Refined at 6.89 MJ/kg and 17% consistency

TABLE V

THE EFFECT OF THE HEAT TREATMENT ON THE WET-WEB AND DRY HANDSHEET PROPERTIES OF HIGH-YIELD PULPS

| | | 78% Yield Sulphite Pulp Refined at 2.20 MJ/kg and 17% consistency | | 70% Yield Sulphite Pulps Refined at 0.64 MJ/kg and 30% consistency | | Refined at 0.78 MJ/kg and 24% consistency | | Refined at 0.57 MJ/kg and 9% consistency | |
|---|---|---|---|---|---|---|---|---|---|
| | | Untreated | Heat treated | Untreated | Heat treated | Untreated | Heat treated | Untreated | Heat treated |
| Pulp and fiber properties | | | | | | | | | |
| Curl index | | 0.169 | 0.220 | 0.147 | 0.237 | 0.138 | 0.227 | 0.148 | 0.216 |
| CSF (ml) | | 236 | 326 | 685 | 601 | 662 | 627 | 673 | 624 |
| Wet-Web properties | | | | | | | | | |
| 0.7 kPa | solids (%) | 20.6 | 19.2 | 27.4 | 24.3 | 27.4 | 23.3 | 26.1 | 21.5 |
| | tensile (m) | 144 | 111 | 74.0 | 91.6 | 91.8 | 78.5 | 82.8 | 84.1 |
| | stretch (%) | 6.38 | 16.2 | 2.10 | 17.8 | 2.19 | 16.6 | 2.38 | 9.79 |
| | work to rupture (MJ/g) | 116 | 244 | 16.2 | 189 | 19.0 | 160 | 20.3 | 110 |
| 103 kPa | solids (%) | 28.3 | 24.6 | 31.1 | 28.6 | 31.8 | 28.9 | 29.1 | 29.2 |
| | tensile (m) | 283 | 183 | 124 | 124 | 158 | 119 | 143 | 145 |
| | stretch (%) | 5.04 | 12.3 | 2.00 | 12.2 | 2.34 | 9.24 | 1.95 | 5.88 |
| | work to rupture (MJ/g) | 162 | 286 | 26.3 | 203 | 36.4 | 133 | 27.3 | 94.6 |
| Wet-Web stretch at 100 m breaking length (%) | | 8.0 | 17.7 | 2.21 | 15.3 | 2.34 | 11.8 | 2.23 | 8.05 |
| Dry handsheet properties | | | | | | | | | |
| Bulk ($cm^3/g$) | | 1.54 | 1.66 | 1.86 | 1.57 | 1.74 | 1.56 | 1.81 | 1.59 |
| Burst index ($kPa \cdot m^2/g$) | | 6.96 | 5.58 | 5.81 | 4.56 | 6.73 | 4.81 | 6.24 | 5.44 |
| Tear index ($mN \cdot m^2/g$) | | 6.33 | 9.98 | 8.76 | 9.85 | 8.26 | 10.07 | 8.22 | 8.71 |
| Breaking length (m) | | 10204 | 7991 | 8750 | 7159 | 9422 | 7041 | 9704 | 8246 |
| Stretch (%) | | 2.89 | 3.71 | 2.68 | 3.20 | 2.79 | 3.16 | 2.63 | 3.00 |
| Toughness index (mJ) | | 177 | 272 | 139 | 138 | 159 | 138 | 150 | 131 |
| Zero-span b.l. (km) | | 14.38 | 14.05 | 15.79 | 14.56 | 16.12 | 14.94 | 16.45 | 16.36 |
| Scattering coeff. ($cm^2/g$) | | 177 | 234 | 212 | 200 | 208 | 208 | 219 | 211 |
| Tappi opacity (%) | | 70.4 | 91.7 | 76.1 | 73.0 | 76.3 | 75.5 | 77.2 | 74.1 |
| Iso-Brightness (%) | | 42.8 | 35.3 | 44.6 | 41.4 | 44.8 | 42.2 | 45.3 | 42.0 |
| Absorption coeff. ($cm^2/g$) | | 13.33 | 21.19 | 15.47 | 16.44 | 14.88 | 16.24 | 14.68 | 16.51 |

Another sample of the same pulp was sprayed with a solution of sodium carbonate to increase its pH to 10.0 and was also given a heat treatment at the same conditions.

Both heat treated pulps show remarkable improvement in wet-web properties and dry tear strength and stretch over the untreated sample (Table VI). The pulp heat treated at high pH has higher strength due to the protective action of the alkali which reduces the loss in fibre strength through acid hydrolysis.

EXAMPLE 7

This example illustrates the effect of pulp bleaching or brightening agents on the wet-web and dry-handsheet strength of heat treated pulps.

A 70% yield sulphite pulp was bleached by a conventional hydrogen peroxide treatment following the heat treatment at 150° C. for 60 minutes and 20% consistency. Results are given in Table VII for the pulps after treatment with different peroxide charges and after a standard hot disintegration. The pulp after bleaching still possesses all the claimed superior properties (with the exception of drainage) resulting from the heat treatment done under the conditions disclosed in this invention.

EXAMPLE 8

As a further example pulps have been heat treated in the way described earlier, with the addition of a brightening agent during the heat treatment stage.

A thermomechanical pulp and a 70%-yield sulphite

TABLE VI

THE EFFECT OF THE PULP FIBRE pH DURING HEAT TREATMENT

| | | 70% yield sulphite pulp[1] | | |
|---|---|---|---|---|
| | | Untreated pulp hot disintegrated | Heat treated pulp at 150° C. for 60 minutes and 20% consistency followed by hot disintegration | |
| pH of heat treatment | | — | 3.2 | 10.0 |
| Pulp and fibre properties | | | | |
| Curl index | | 0.135 | 0.237 | 0.253 |
| CSF (ml) | | 643 | 610 | 672 |
| 0.7 kPa | solids (%) | 25.4 | 22.1 | 26.7 |
| | tensile (m) | 103 | 89.5 | 67.8 |
| | stretch (%) | 2.67 | 15.8 | 7.38 |
| | work to | 25.1 | 157 | 52.6 |

TABLE VI-continued

THE EFFECT OF THE PULP FIBRE pH DURING HEAT TREATMENT

| | | 70% yield sulphite pulp[1] | | |
|---|---|---|---|---|
| | | Untreated pulp hot disintegrated | Heat treated pulp at 150° C. for 60 minutes and 20% consistency followed by hot disintegration | |
| 103 kPa | rupture | | | |
| | solids (%) | 29.0 | 28.2 | 29.4 |
| | tensile (m) | 169 | 141 | 103 |
| | stretch (%) | 2.54 | 9.61 | 6.19 |
| | work to rupture | 34.4 | 142 | 67.0 |
| Wet-Web stretch at 100 m breaking length | | 2.89 | 13.5 | 6.24 |
| Dry handsheet properties | | | | |
| Bulk ($cm^3/g$) | | 1.72 | 1.54 | 1.78 |
| Burst index ($kPa \cdot m^2/g$) | | 6.70 | 4.71 | 3.43 |
| Tear index ($mN \cdot m^2/g$) | | 8.15 | 9.78 | 16.41 |
| Breaking length (m) | | 9924 | 7383 | 5547 |
| % stretch | | 2.89 | 3.03 | 2.99 |
| Toughness index (mJ) | | 167 | 137 | 107 |
| Zero-span b.l. (km) | | 16.38 | 14.95 | 14.35 |
| Scattering coeff. ($cm^2/g$) | | 205 | 209 | 263 |
| Tappi opacity (%) | | 74.6 | 74.9 | 93.7 |
| Iso-brightness (%) | | 44.4 | 43.0 | 21.5 |
| Absorption coeff. ($cm^2/g$) | | 14.86 | 15.22 | 50.50 |

[1]Refined at 0.99 mJ/kg and 18% consistency

A thermomechanical pulp and a 70% yield sulphite pulp at about 30% consistency were sprayed with a solution of 2% $H_2O_2$, 0.4% EDTA, 3% $Na_2S_iO_3$, 0.005% $MgSO_4$, to bring it to 19% consistency. The pulps were treated at 150° C. for 10 minutes.

Results are given in Table VIII. Both pulps are higher in visual efficiency than the control and possess all the other desired superior properties.

EXAMPLE 9

This example illustrates the effect of the heat treatment on bleached or brightened pulps.

A 70% yield sulphite pulp and a thermomechanical pulp at about 30% consistency were sprayed with a solution of 2% $H_2O_2$, 0.4% EDTA, 3% $Na_2SiO_3$ and 0.005% $MgSO_4$ to bring it to 19% consistency. The pulps reacted with the chemicals for one hour at 60° C. Afterwards, the pulps were heat treated at 150° C. for 10 minutes.

Results are given in Table IX for the original pulps before heat treatment, the brightened pulps and for both pulps after heat treatment. The heat treatment, done under the conditions disclosed herein on the brightened pulp compared to the original pulp gave similar properties while it had higher visual efficiency.

TABLE VII

THE EFFECT OF BLEACHING HEAT-TREATED PULPS

| | | Before Heat Treatment | 70% Yield Sulphite Pulp[1] After heat treatment at 150° C. for 60 minutes and 20% consistency followed by peroxide bleaching | | | |
|---|---|---|---|---|---|---|
| Weight of Peroxide on Pulp (%) | | — | 0 | 0.5 | 1.0 | 2.0 |
| Pulp and Fibre Properties | | | | | | |
| Curl Index | | 0.138 | 0.227 | 0.216 | 0.209 | 0.204 |
| CSF (ml) | | 662 | 607 | 583 | 533 | 524 |
| Wet-Web Properties | | | | | | |
| 0.7 kPa | Solids (%) | 27.4 | 23.3 | 22.9 | 25.0 | 22.7 |
| | Tensile (m) | 91.8 | 87.7 | 92.2 | 93.7 | 95.9 |
| | Stretch (%) | 2.19 | 15.1 | 12.8 | 14.0 | 16.5 |
| | Work to rupture | 19.0 | 150 | 131 | 165 | 210 |
| 103 kPa | Solids (%) | 31.8 | 29.0 | 28.1 | 32.8 | 25.3 |
| | Tensile (m) | 158 | 133 | 139 | 180 | 151 |
| | Stretch (%) | 2.34 | 9.31 | 9.26 | 8.95 | 8.48 |
| | Work to rupture | 36.4 | 148 | 150 | 171 | 162 |
| Wet-Web stretch at 100 m breaking length (%) | | 2.34 | 13.02 | 12.82 | 13.82 | 15.0 |
| Dry Handsheet Properties | | | | | | |
| Bulk ($cm^3/g$) | | 1.74 | 1.54 | 1.53 | 1.47 | 1.49 |
| Burst Index ($kPa \cdot m^2/g$) | | 6.73 | 4.50 | 4.70 | 5.23 | 5.18 |
| Tear Index ($mN \cdot m^2/g$) | | 8.26 | 10.40 | 10.75 | 10.64 | 10.04 |
| Breaking Length (m) | | 9422 | 6754 | 6814 | 7389 | 7302 |
| Stretch (%) | | 2.79 | 3.26 | 3.43 | 3.50 | 3.48 |
| Toughness Index (mJ) | | 159 | 143 | 148 | 170 | 163 |
| Zero-span b.l. (km) | | 16.12 | 14.38 | 14.42 | 14.48 | 14.98 |
| Scattering Coeff. ($cm^2/g$) | | 208 | 211 | 206 | 196 | 198 |
| Tappi Opacity (%) | | 76.3 | 76.8 | 61.5 | 68.7 | 66.4 |
| Iso-Brightness (%) | | 44.8 | 42.1 | 49.3 | 52.9 | 56.6 |
| Absorption Coeff. ($cm^2/g$) | | 14.88 | 16.36 | 7.02 | 5.23 | 4.03 |
| Visual Efficiency (%) | | 56.0 | 53.6 | 63.5 | 67.0 | 70.5 |
| Printing Opacity (%) | | 86.0 | 86.6 | 69.6 | 77.0 | 73.7 |

[1]Refined at 0.78 MJ/kg and 24% consistency

TABLE VIII

THE EFFECT OF THE ADDITION OF A BRIGHTENING AGENT TO PULP DURING THE HEAT TREATMENT

| | | 70% YIELD SULPHITE PULP[1] | | | TMP[2] | | |
|---|---|---|---|---|---|---|---|
| | | | Heat Treatment at 150° C., 10 min, 19% consistency with | | | Heat Treatment at 150° C., 10 min, 19% consistency with | |
| | | Before Heat Treatment | No Bleaching Chemicals | 2% $H_2O_2$ 0.4% EDTA 3% $Na_2SiO_3$ 0.005% $MgSO_4$ | Before Heat Treatment | No Bleaching Chemicals | 2% $H_2O_2$ 0.4% EDTA 3% $Na_2SiO_3$ 0.005% $MgSO_4$ |
| Pulp and Fibre Properties | | | | | | | |
| Curl Index | | 0.148 | 0.187 | 0.209 | 0.106 | 0.177 | 0.163 |
| CSF (ml) | | 673 | 651 | 685 | 175 | 312 | 293 |
| Wet-Web Properties | | | | | | | |
| 0.7 kPa | Solids (%) | 26.1 | 26.5 | 25.1 | 20.6 | 25.9 | 23.4 |
| | Tensile (m) | 82.8 | 92.4 | 80.1 | 110 | 86.1 | 96.1 |
| | Stretch (%) | 2.38 | 3.32 | 5.04 | 5.02 | 10.1 | 10.1 |
| | Work to rupture | 20.3 | 32.0 | 43.7 | 68.4 | 117 | 122 |
| 103 kPa | Solids (%) | 29.1 | 32.5 | 32.1 | 25.0 | 32.3 | 29.3 |
| | Tensile (m) | 143 | 147 | 127 | 167 | 144 | 150 |
| | Stretch (%) | 1.95 | 2.53 | 3.49 | 4.42 | 8.22 | 7.24 |
| | Work to rupture | 27.3 | 38.1 | 44.7 | 86.8 | 159 | 144 |
| Wet-Web stretch at 100 m breaking length (%) | | 2.23 | 2.90 | 4.05 | 5.22 | 9.61 | 8.93 |
| Dry Handsheet Properties | | | | | | | |
| Bulk ($cm^3/g$) | | 1.81 | 1.65 | 1.79 | 2.79 | 3.10 | 2.96 |
| Burst Index ($kPa \cdot m^2/g$) | | 6.24 | 5.78 | 4.38 | 2.02 | 1.36 | 1.50 |
| Tear Index ($mN \cdot m^2/g$) | | 8.22 | 7.84 | 7.84 | 8.72 | 8.27 | 8.94 |
| Breaking Length (m) | | 9704 | 9251 | 7361 | 3625 | 2469 | 2792 |
| Stretch (%) | | 2.63 | 2.71 | 2.32 | 2.15 | 2.05 | 2.07 |
| Toughness Index (mJ) | | 150 | 156 | 113 | 45 | 32 | 37 |
| Zero-span b.l. (km) | | 16.45 | 16.23 | 13.96 | 11.20 | 9.78 | 10.47 |
| Scattering Coeff. ($cm^2/g$) | | 219 | 203 | 238 | 568 | 568 | 581 |
| Tappi Opacity (%) | | 77.2 | 76.1 | 79.7 | 93.8 | 95.1 | 93.3 |
| Iso-Brightness (%) | | 45.3 | 41.7 | 42.8 | 56.0 | 50.9 | 55.8 |
| Absorption Coeff. ($cm^2/g$) | | 14.68 | 15.10 | 9.22 | 20.23 | 20.49 | 9.83 |
| Visual Efficiency (%) | | 56.6 | 54.3 | 60.4 | 67.3 | 64.4 | 71.2 |

[1]Refined at 0.57 MJ/kg and 9% consistency
[2]Refined at 8.52 MJ/kg and 35% consistency after second stage

TABLE IX

THE EFFECT OF THE HEAT TREATMENT ON BLEACHED OR BRIGHTENED PULPS

| | | 70% YIELD SULPHITE PULP[1] | | | | TMP[2] | | | |
|---|---|---|---|---|---|---|---|---|---|
| | | (a) Original Pulp | (b) | Heat Treatment at 150° C., 10 min. | | (a) Original Pulp | (b) Pulp (a) | Heat Treatment at 150° C., 10 min. | |
| | | Before Heat Treatment | Pulp (a) Brightened | Original Pulp (a) | Brightened Pulp (b) | Before Heat Treatment | Bright-ened | Original Pulp (a) | Brightened Pulp (b) |
| Pulp and Fibre Properties | | | | | | | | | |
| Curl Index | | 0.108 | 0.157 | 0.215 | 0.223 | 0.106 | 0.113 | 0.177 | 0.167 |
| CSF (ml) | | 715 | 687 | 681 | 707 | 175 | 187 | 312 | 308 |
| Wet-Web Properties | | | | | | | | | |
| 0.7 kPa | Solids (%) | 26.8 | 26.3 | 27.7 | 28.0 | 20.6 | 21.1 | 25.9 | 21.5 |
| | Tensile (m) | 77.2 | 79.8 | 59.1 | 62.5 | 110 | 105 | 86.1 | 82.5 |
| | Stretch (%) | 1.71 | 1.77 | 2.99 | 3.49 | 5.02 | 5.44 | 10.1 | 11.3 |
| | Work to rupture | 14.5 | 12.0 | 20.3 | 23.6 | 68.4 | 71.9 | 117 | 114 |
| 103 kPa | Solids (%) | 33.5 | 31.5 | 29.2 | 30.5 | 25.0 | 27.5 | 32.3 | 26.4 |
| | Tensile (m) | 160 | 119 | 100 | 89.4 | 167 | 157 | 144 | 129 |
| | Stretch (%) | 1.63 | 1.73 | 2.49 | 2.84 | 4.42 | 4.75 | 8.22 | 8.38 |
| | Work to rupture | 27.7 | 17.3 | 26.4 | 29.2 | 86.8 | 94.9 | 159 | 124 |
| Wet-Web stretch at 100 m breaking length (%) | | 1.81 | 1.74 | 3.02 | 2.74 | 5.22 | 5.54 | 9.61 | 10.0 |
| Dry Handsheet Properties | | | | | | | | | |
| Bulk ($cm^3/g$) | | 1.87 | 1.80 | 1.68 | 1.80 | 2.79 | 2.78 | 3.10 | 2.94 |
| Burst Index ($kPa \cdot m^2/g$) | | 6.09 | 6.17 | 5.01 | 4.35 | 2.02 | 2.07 | 1.36 | 1.43 |
| Tear Index ($mN \cdot m^2/g$) | | 7.99 | 7.35 | 8.54 | 7.48 | 8.72 | 8.92 | 8.27 | 8.34 |
| Breaking Length (m) | | 9054 | 10033 | 7675 | 7300 | 3625 | 3814 | 2469 | 2713 |
| Stretch (%) | | 2.62 | 2.60 | 2.85 | 2.50 | 2.15 | 2.13 | 2.05 | 1.95 |
| Toughness Index (mJ) | | 128 | 146 | 131 | 109 | 45 | 47 | 32 | 33 |
| Zero-span b.l. (km) | | 15.68 | 16.39 | 15.43 | 13.80 | 11.20 | 11.08 | 9.78 | 9.92 |
| Scattering Coeff. ($cm^2/g$) | | 221 | 220 | 215 | 241 | 568 | 555 | 568 | 570 |
| Tappi Opacity (%) | | 73.8 | 69.1 | 75.3 | 73.8 | 93.8 | 87.7 | 95.1 | 91.8 |
| Iso-Brightness (%) | | 46.5 | 53.2 | 42.2 | 46.5 | 56.0 | 67.8 | 50.9 | 56.6 |
| Absorption Coeff. ($cm^2/g$) | | 13.79 | 4.90 | 13.85 | 6.14 | 20.23 | 3.91 | 20.49 | 8.95 |
| Visual Efficiency (%) | | 57.9 | 68.9 | 55.2 | 65.2 | 67.3 | 81.1 | 64.4 | 72.0 |

TABLE IX-continued

THE EFFECT OF THE HEAT TREATMENT ON BLEACHED OR BRIGHTENED PULPS

| | 70% YIELD SULPHITE PULP[1] | | | | TMP[2] | | | |
|---|---|---|---|---|---|---|---|---|
| | (a) Original Pulp | (b) | Heat Treatment at 150° C., 10 min. | | (a) Original Pulp | (b) Pulp (a) | Heat Treatment at 150° C., 10 min. | |
| | Before Heat Treatment | Pulp (a) Brightened | Original Pulp (a) | Brightened Pulp (b) | Before Heat Treatment | Bright-ened | Original Pulp (a) | Brightened Pulp (b) |
| Printing Opacity (%) | 83.6 | 76.6 | 85.1 | 81.7 | 96.2 | 89.7 | 97.1 | 94.5 |

[1]Refined at 0.50 MJ/kg and 15% consistency
[2]Refined at 8.52 MJ/kg and 35% consistency after second stage

We claim:

1. A method for treating high yield or mechanical pulps that have already been curled by a high consistency action in order to improve at least some of the following physical properties: drainage, wet-web stretch, wet-wet work-to-rupture, and dry-sheet tear strength and stretch, which method comprises: subjecting said curled pulp fibres to a heat treatment at a temperature of 100° C.–170° C. for a time varying between 60 minutes and 2 minutes, while said pulp is at a high consistency of 15% to 35% in the form of nodules or entangled mass, said heat treatment being sufficient to render said curl permanent to subsequent mechanical action.

2. The method of claim 1 wherein said heat treatment is carried out as a batch method, in a digester.

3. The method of claim 1 wherein said heat treatment is carried out as a continuous method through a steaming tube maintained at high pressure.

4. The method of claim 1 wherein said pulp fibres are lignocellulosic pulp fibres produced by mechanical defibration.

5. The method of claim 1 wherein said pulp fibres are lignocellulosic pulp fibres produced by refining.

6. The method of claim 1 wherein said pulp fibres are lignocellulosic pulp fibres produced by refining in a disc refiner at high consistency.

7. The method of claim 1 wherein said pulp fibres are lignocellulosic pulp fibres produced by mechanical defibration of wood chips at high consistency.

8. The method of claim 1 wherein said pulp fibres are lignocellulosic pulp fibers produced by mechanical defibration of wood chips at high consistency followed or preceded by a chemical treatment.

9. The method of claim 1 wherein said pulp fibres are lignocellulosic pulp fibres obtained after a single stage refining, or, after two successive refinings, or, between two successive refinings.

10. The method of claim 1 wherein said pulp fibres are lignocellulosic pulp fibres at neutral or alkaline pH.

11. The method of claim 1 wherein said pulp fibres are refiner mechanical pulp, pressurized refiner mechanical pulp and thermomechanical pulp either from a single stage or two-stage refining.

12. The method of claim 1 wherein said pulp fibres are ultra-high yield pulps, high-yield pulps, high-yield chemi-thermomechanical pulps, chemimechanical pulps, interstage thermomechanical pulps and chemically post-treated mechanical or thermomechanical pulps.

13. The method of claim 1 wherein said pulp fibres are part of a furnish.

14. The method of claim 1 wherein said pulp fibres are the refined rejects in mechanical or high yield pulp production.

15. The method of claim 1 wherein said pulp fibres are whole pulps of a furnish.

16. The method of claim 1 including the step of incorporating a brightening agent during heat treatment, to upgrade the brightness while retaining the improved pulp properties.

17. The method of claim 1 including the subsequent steps of brightening or bleaching sequences to upgrade the brightness of the pulps while maintaining the improved pulp properties.

18. The method of claim 1 wherein said pulps, are brightened pulps, thereby to maintain adequate brightness after heat treatment as well as the improved pulp properties.

19. The method of claim 1 wherein said pulp fibres are lignocellulosic fibres produced by treatment in a mechanical fiber-curling device.

* * * * *